United States Patent [19]

McLaren et al.

[11] 4,305,524

[45] Dec. 15, 1981

[54] ROUND ICE CREAM CARTON LID

[75] Inventors: Edwin C. McLaren, Apple Valley; David J. Adamek, Minneapolis, both of Minn.

[73] Assignee: Champion International Corporation, Stamford, Conn.

[21] Appl. No.: 137,453

[22] Filed: Apr. 4, 1980

[51] Int. Cl.[3] ..... B65D 41/16; B65D 41/18

[52] U.S. Cl. ..... 220/306; 229/5.6; 229/43

[58] Field of Search ..... 229/5.6, 5.5, 43; 220/306; 206/503, 509, 508

[56] References Cited

U.S. PATENT DOCUMENTS

| | | | |
|---|---|---|---|
| 1,965,418 | 7/1934 | Bombard | 220/306 X |
| 3,137,574 | 3/1965 | Goldsmith | 206/508 |
| 3,179,283 | 4/1965 | Amberg | 220/306 |
| 3,504,823 | 4/1970 | Logomasini | 220/306 |
| 3,516,572 | 6/1970 | Davis | 220/306 |
| 3,722,731 | 3/1973 | McCormick et al. | 220/306 |
| 3,880,288 | 4/1975 | Hunter | 220/306 X |
| 3,973,719 | 8/1976 | Johnson et al. | 229/5.6 |
| 4,008,846 | 2/1977 | Gordon | 229/5.6 |
| 4,183,457 | 1/1980 | Loughley | 229/5.5 |
| 4,209,107 | 6/1980 | Crisci | 220/306 |
| 4,225,045 | 9/1980 | Rayner | 220/306 X |
| 4,230,230 | 10/1980 | Mumford | 220/306 X |

*Primary Examiner*—Davis T. Moorhead

*Attorney, Agent, or Firm*—Evelyn M. Sommer

[57] ABSTRACT

A closure for a cylindrically shaped ice cream carton or the like includes a unitary circular shaped plastic lid provided with a depending skirt portion. The top surface of the lid includes an inverted V-shaped bead extending concentric with and inwardly spaced from the outer circumference of the lid to provide a bead for retaining a plurality of similar lids in stacked relation, precluding them from slipping inwardly relative to each other. The top surface of the lid also includes a depressed centrally located area, which rigidifies the lid and provides a recess for labels containing printed indicia. The skirt of the lid includes a bottom, outwardly flared portion enabling the lid to be grasped and readily removed from tight fitting engagement with an ice cream carton and an upper, recessed portion to accommodate expansion of the ice cream carton without the lid popping off the carton.

10 Claims, 4 Drawing Figures

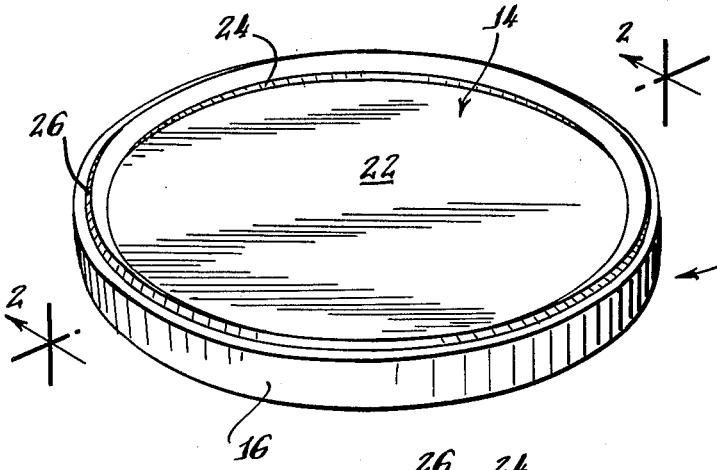
Fig. 1.
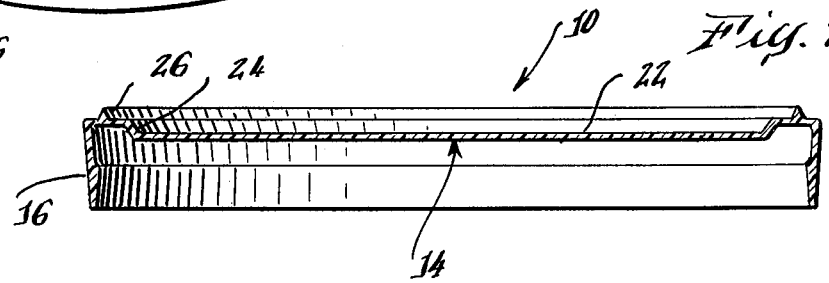
Fig. 2.
Fig. 3.
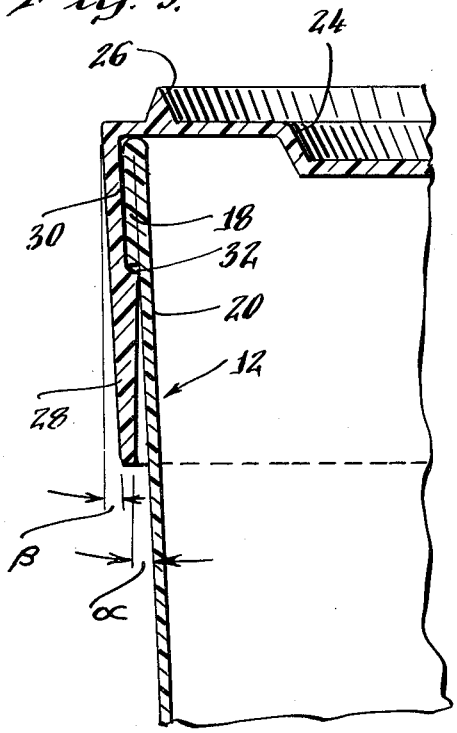
Fig. 4.
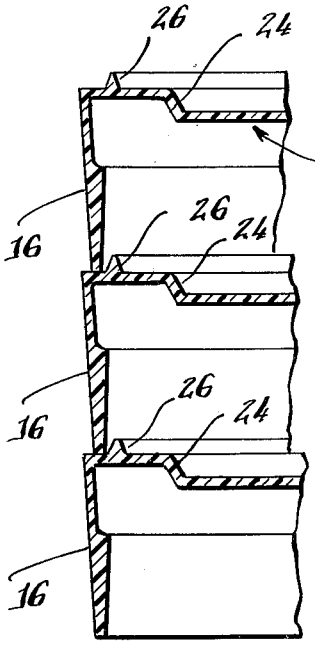

ROUND ICE CREAM CARTON LID

BACKGROUND OF THE INVENTION

1. Field of the Invention

This invention generally relates to closures for packaging containers and more particularly, to a removable lid for a cylindrical container, such as a round ice cream carton or the like.

2. Description of the Prior Art

In the past, removable lids for cylindrical cartons used for packaging ice cream or the like have been formed from paper stock and are often of a two piece construction. One piece of the lid was formed from a strip of material folded in a manner to provide a rolled edge and a pair of essentially straight, parallel, spaced apart annular shaped side walls. When installed on the carton, the rolled edge of the lid engaged the upper rim of the carton while the side walls of the lid were respectively disposed on the inner and outer surface of the carton rim. The second piece of the lid consisted of a circularly shaped piece of paper stock having the periphery thereof provided with extensions suitable for attachment, as by gluing, to the inner side wall of the first mentioned piece of the lid. The second circular piece of the lid was normally preprinted with various indicia to identify the manufacturer or contents of the carton, prior to assembly of the separate pieces of the lid.

Others in the past have also devised a one piece lid formed from paper stock, which is similar in construction design to the lid mentioned above and is provided with side walls forming a ring-shaped opening within which the rim of the carton is slidably received.

Prior art lids of the types described above are less than completely desirable for several reasons. First, the fit between the side walls of the lid and the carton rim was relatively loose unless sufficient friction could be produced between the side walls of the lid and the rim; this was sometimes achieved by spacing the side walls a distance marginally less than the thickness of the rim and/or extending the width of the lid side walls to create additional friction producing surface areas. Reduction of the spacing between the lid side walls naturally made it more difficult for a user to guide and start the carton rim into the opening between the side walls of the lid, and the provision of wider lid side walls necessitated the use of additional stock material, thereby diminishing manufacturing economy. In the case of a two piece paper stock lid construction, the additional labor costs associated with assembly thereof was also undesirable from the standpoint of economy. Finally, the necessity for preprinting the face of the lid, prior to assembly thereof added further undesirable manufacturing costs to this type of lid and also posed logistical problems since such lids could not be assembled and installed on the cartons prior to the application of the necessary printed indicia. Also, once these prior art lids were installed on the cartons, it was sometimes difficult to remove the lids since the outer side walls of the lid was, by necessity, closely contoured to the outer surface areas of the carton, making it difficult to apply upwardly directed pressure on the free extremity of the lid side wall.

Finally, because of the close proximity of the lid to the side walls of the carton, the ice cream in the carton, when removed from a refrigerator, would have a tendency to thaw, and when replaced in the refrigerator would expand, often popping the lid from the carton rim.

From the foregoing, it is clear that a need exists in the art for a circular lid for closing the end of a cylindrically shaped carton which is not only economical from a manufacturing standpoint, but easy to install and remove from the carton and allows the application thereto of a label having preprinted indicia thereon. Further, such a carton lid should be capable of being tightly adhered to seal the carton and provide the requisite closure therefore under all a conditions of use of the carton.

SUMMARY OF THE INVENTION

The present invention provides a lid which satisfies each of the aforementioned needs. According to the present invention, a closure for a cylindrically shaped ice cream carton or the like includes a unitary circular shaped plastic lid provided with a depending skirt portion. The top surface of the lid includes an inverted V-shaped bead extending concentric with and inwardly spaced from the outer circumference of the lid to provide a bead for retaining a plurality of similar lids in stacked relation during storage, precluding them from slipping inwardly relative to each other. The top surface of the lid also includes a depressed centrally located area, which rigidifies the lid and provides a recess for labels containing printed indicia. The skirt of the lid includes a bottom, outwardly flared portion enabling the lid to be grasped and readily removed from the tight fitting engagement with an ice cream carton and an upper, recessed portion to accommodate expansion of the ice cream carton without the lid popping off the carton, while enabling the lid to be placed in tight sealing engagement with the rim or lip of a round or cylindrical ice cream carton.

BRIEF DESCRIPTION OF THE DRAWINGS

Further objects and advantages of the invention will become apparent from the following description claims, and from the accompanying drawing, wherein:

FIG. 1 is a perspective view of the lid or closure of the present invention;

FIG. 2 is a cross-sectional view of the lid of FIG. 1 taken substantially along the plane indicated by line 2—2 of FIG. 1;

FIG. 3 is an enlarged cross-sectional view of a portion of the lid of FIG. 2, applied to a cylindrical container; and FIG. 4 is a cross-sectional view of a portion of the lids of the present invention, with the lids stacked for storage.

DETAILED DESCRIPTION OF THE PREFERRED EMBODIMENT

Referring now to the driwing in detail, wherein like numerals indicate like elements throughout the several views, a closure 10 particularly adapted for use with a cylindrically shaped ice cream carton 12 or the like generally comprises a circularly shaped disc portion 14 provided with an annular, depending skirt 16. The circularly shaped disc 14 is adapted to close the mouth of carton 12 and the annular skirt 16 is adapted to abut the rim or lip 18 and side walls 20 of carton 12.

The closure or lid 10 is preferably made from low density polyethylene material. Disc portion 14 includes a centrally located, depressed flat or planar area 22 bordered by a downwardly extending and flared annular wall 24. The depressed wall 24 tends to rigidify the lid structure and reduces the overall volume of the lid 10. The circular depressed planar area 22 of disc portion 14 of lid 10 can also receive a preprinted label containing suitable indicia (not shown) which can be adhered thereto and located expediently by virtue of the outline formed by the downwardly extending and flared annular wall 24.

A substantially inverted, V-shaped in cross-section, rim 26 is provided on the upper surface of disc 14 between circular depressed area 22 and the outer circumferential, peripheral edge of the disc. As illustrated in FIG. 4, the upright rim 26 on each lid 10 enables the lids to be stacked during storage so that they do not move radially with respect to each other, as the lower extremity of the skirt 16 on each lid will abut a rim on a lower lid 10 upon sideways movement being imparted thereto.

The skirt portion 16 of each closure or lid 10 includes a lower portion 28 and upper portion 30. Lower or terminal portion 28 of skirt 16 has an inner edge making an angle $\alpha$ of approximately 5° with the vertical. The outer edge of skirt portion 28 is contiguous with the outer edge of the upper skirt portion 30 and forms an angle $\beta$ with the vertical of between 1° to 4°. The inner edge of the upper portion 30 of skirt 16 is undercut so as to provide an annular shoulder 32 defining the boundary between the lower and upper portions 28 and 30 of skirt 16.

By virtue of the outward flare of the lower portion 28 of skirt 16 the skirt 16 and lid 10 is readily slid over the extended rim 18 and side wall 20 of round ice cream carton 12 and rim 18 is readily seated between the lower surface of the central circular disc portion 14 and shoulder 32 of skirt 16 to lock the lid 10 to the carton 12. Further, because of the outward flare of lower portion 28 of skirt 16, a finger can be inserted beneath the lid and the skirt portion 16 pivoted outwardly so that shoulder 32 can clear the rim so that the skirt can be removed along with the lid from the carton 12.

It should also be noted that the rim 18 is spaced slightly inwardly from the inner surface of the upper portion 30 of skirt 16 when lid or closure 10 is snapped over the mouth of carton 12. This permits for expansion of the ice cream carton 12 upon subsequent refreezing and expansion after removal from a refrigerator, precluding the lid from popping off the carton 12. Even should expansion upon refreezing of the ice cream within the carton be pronounced, by virtue of the deviation of the outer edge of upper and lower skirt portions 28 and 30 from the vertical by the angle $\beta$, the skirt can be pivoted outwardly to a vertical position where $\beta$ is equal to 0° without removing the sealing engagement of the shoulder 32 with the rim 18.

What is claimed as new is:

1. A closure for an ice cream carton or the like of the type having a circular rim defining a dispensing opening therein, comprising:

a unitary, circularly shaped lid including a circular disc and an annular skirt portion depending downwardly from the periphery of said circular disc, said skirt portion including an upper and lower portion having a smooth contiguous outer surface and the inner surface of said upper skirt portion being recessed radially inwardly with respect to the inner surface of the lower portion of said skirt to define a locking shoulder therebetween, the inner surface of said lower skirt portion being flared outwardly at a first acute angle with respect to the vertical, and the outer contiguous surface of said upper and lower portions of said skirt being tapered inwardly at a second acute angle with the vertical.

2. The closure of claim 1 wherein said first angle is approximately 5°.

3. The closure of claim 1 wherein said second angle is approximately 1° to 4°.

4. The closure of claim 3 wherein said first angle is approximately 5°.

5. The closure of claim 1 wherein said top circular disc includes a centrally located depressed area.

6. The closure of claim 5 wherein said depressed area is substantially circular in plan and is bounded by an annular wall extending inwardly towards the center of said depressed area.

7. The closure of claim 1 including an annular rib extending upwardly from the circular top disc of said closure adjacent to the peripheral edge thereof.

8. The closure of claim 7 wherein said top circular disc includes a centrally located depressed area.

9. The closure of claim 8 wherein said rib is located between said depressed area and the outer peripheral edge of said top closure disc.

10. The closure of claim 1 wherein the inside diameter of the inner surface of said upper skirt portion is of slightly larger dimension than the outside diameter of said circular rim whereby an area is provided for expansion of the contents of said carton when covered by said closure.

* * * * *